United States Patent [19]

Klein

[11] 4,085,970

[45] Apr. 25, 1978

[54] PAPERBOARD CHAIR OF UNITARY CONSTRUCTION

[75] Inventor: Sheldon D. Klein, Chicago, Ill.

[73] Assignee: Chippewa Paper Products Company, Hillside, Ill.

[21] Appl. No.: 707,375

[22] Filed: Jul. 21, 1976

[51] Int. Cl.[2] ..... A47C 7/00

[52] U.S. Cl. ..... 297/440; 297/442

[58] Field of Search ..... 297/440, 442

[56] References Cited

U.S. PATENT DOCUMENTS

| | | | |
|---|---|---|---|
| 3,606,459 | 9/1971 | Krone | 297/440 |
| 3,695,703 | 10/1972 | Notko | 297/442 |

*Primary Examiner*—James C. Mitchell

*Attorney, Agent, or Firm*—Glenn E. Klepac; Michael G. Berkman

[57] ABSTRACT

A unitary chair of relatively stiff corrugated paperboard formed from a single die-stamped and scored blank, characterized in that it constitutes a base including side panels provided with a pair of opposed slots which are adapted to receive and to lock in interengagement the free ends of both a pivotal seat panel and a pivotal back rest panel. The slots are formed at the junctures of the seat supporting edges of the side panels with the back rest supporting edges of the side panels.

2 Claims, 13 Drawing Figures

PAPERBOARD CHAIR OF UNITARY CONSTRUCTION

BACKGROUND OF THE INVENTION

It is known in the prior art to fabricate chairs and other furniture items from cardboard or corrugated board and the like. Such chairs in various structural forms and in various designs have been made for use as toys, for children's furniture, as well as for adult use. It will be appreciated that the relatively low cost of the raw materials involved makes it possible to produce such furniture items inexpensively, even to the extent of justifying a relatively brief useful life.

While many different chair designs or structures have been suggested in the past, none of these has met with general acceptance or marketing success. It is believed that this may be due, at least in part, to the relative complexity of prior art structures and to some difficulty in set up or assembly of the articles at the point of use, such articles ordinarily being shipped in a knocked-down or flat form to minimize costs. It has, accordingly, been a principal aim of the present invention to provide an improved, simplified, paperboard chair which may be shipped flat but which is readily assembled without the use of tools, with a minimum of difficulty, and requiring only simple assembly directions.

BRIEF DESCRIPTION OF THE INVENTION AND THE DRAWINGS

It is an important feature of the invention that the chair structure is fabricated from a single die-stamped and pre-scored blank in which all the chair elements are integrally connected. Such elements include a pair of side panels, a front panel and a back panel bridging between the side panels, a seat panel hinged to the front panel, and a back rest panel hinged to the back panel. The seat panel and the back rest panel terminate in marginal portions which lockingly interengage the side panels at slots formed therein, whereby the seat and back rest panels are firmly secured in place and the structure mechanically stabilized.

Other features and advantages of the invention will be apparent upon consideration of the following detailed description and the accompanying drawings, in which FIG. 1 is a perspective view of the unitary paperboard chair of the invention, in an assembled state;

DESCRIPTION OF PREFERRED EMBODIMENT

Figure 1:
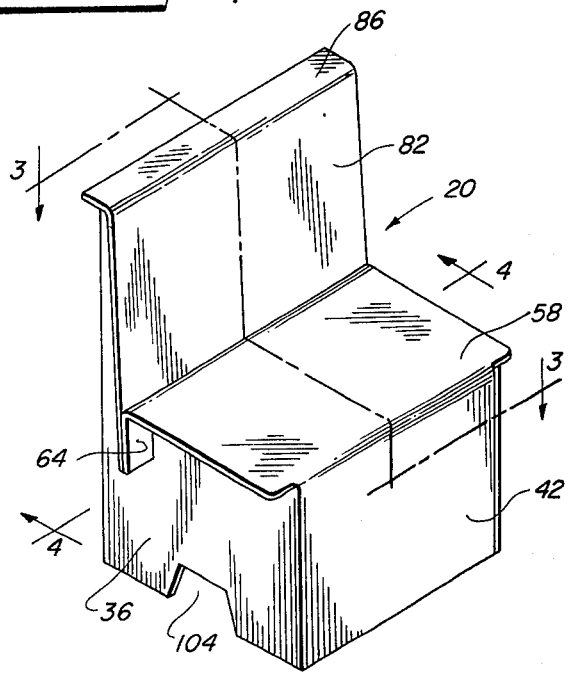
Figure 2:
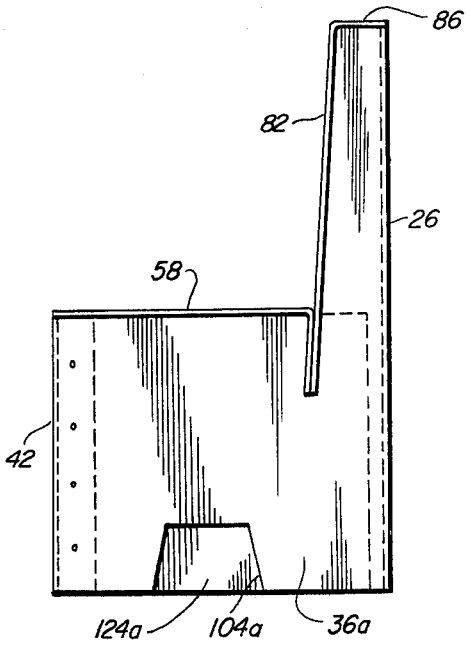
FIG. 2 is a side elevational view.
Figure 3:
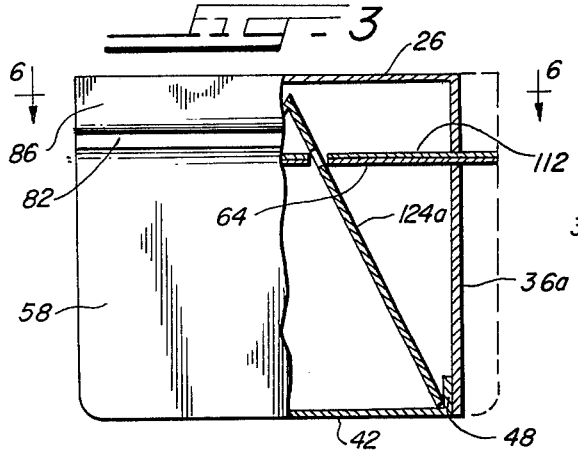
FIG. 3 is a top plan view of the chair with portions of the seat panel and the back rest panel cut away to show understructure, and taken substantially on the lines 3—3 of FIG. 1.
Figure 4:
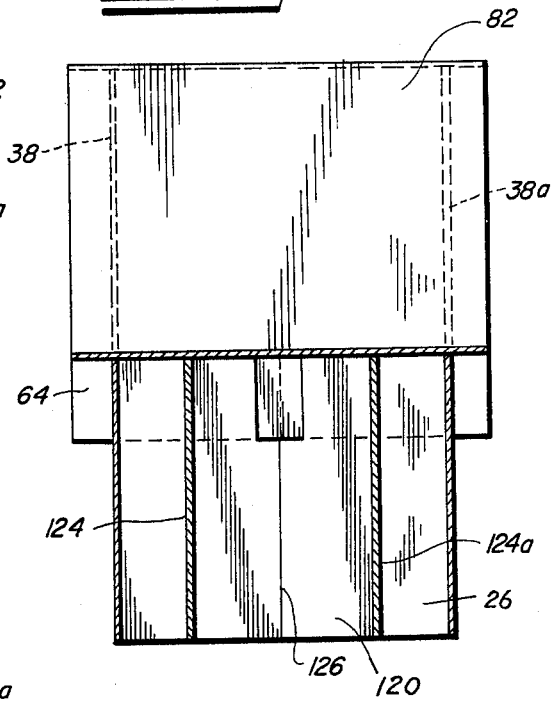
FIG. 4 is a cross sectional view taken substantially on the lines 4—4 of FIG. 1.
Figure 5:
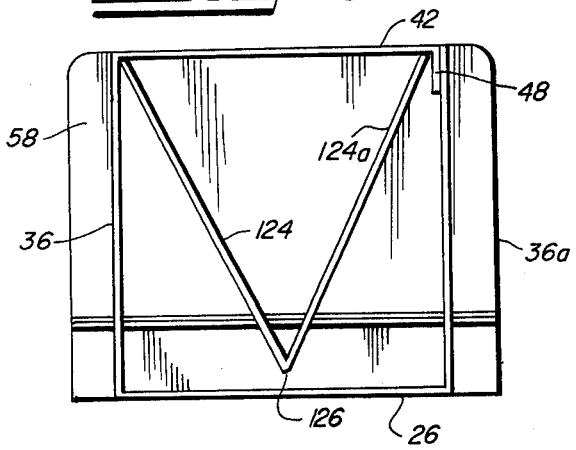
FIG. 5 is a bottom plan view of a preferred embodiment of the chair of the invention.
Figure 6:
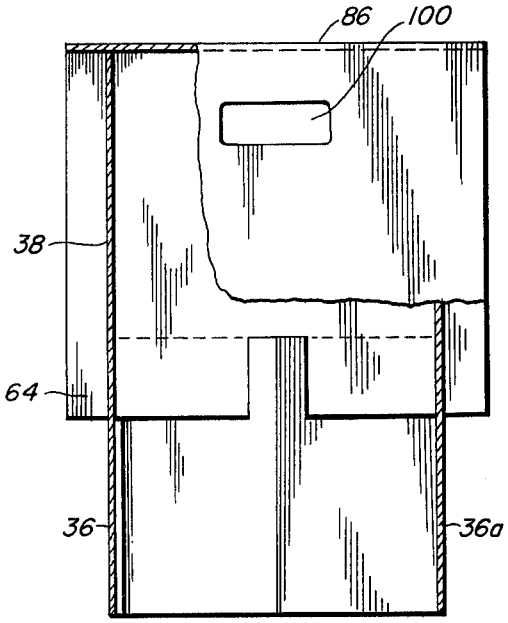
FIG. 6 is a cross sectional view taken substantially on the lines 6—6 of FIG. 3.
Figure 7:
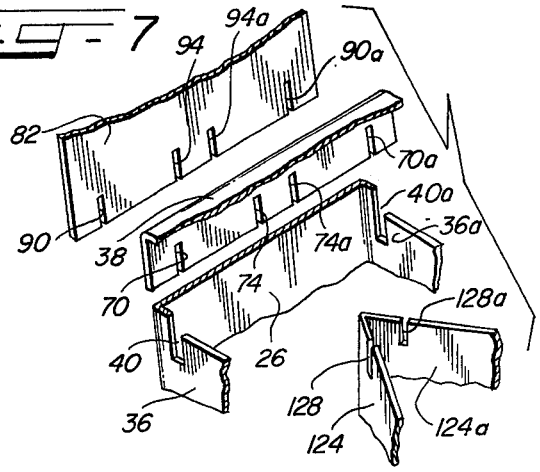
FIG. 7 is a fragmentary, exploded view indicating schematically the manner of interengagement of the various interlocking elements of the chair with the base and with an optional under support member.
Figure 12:
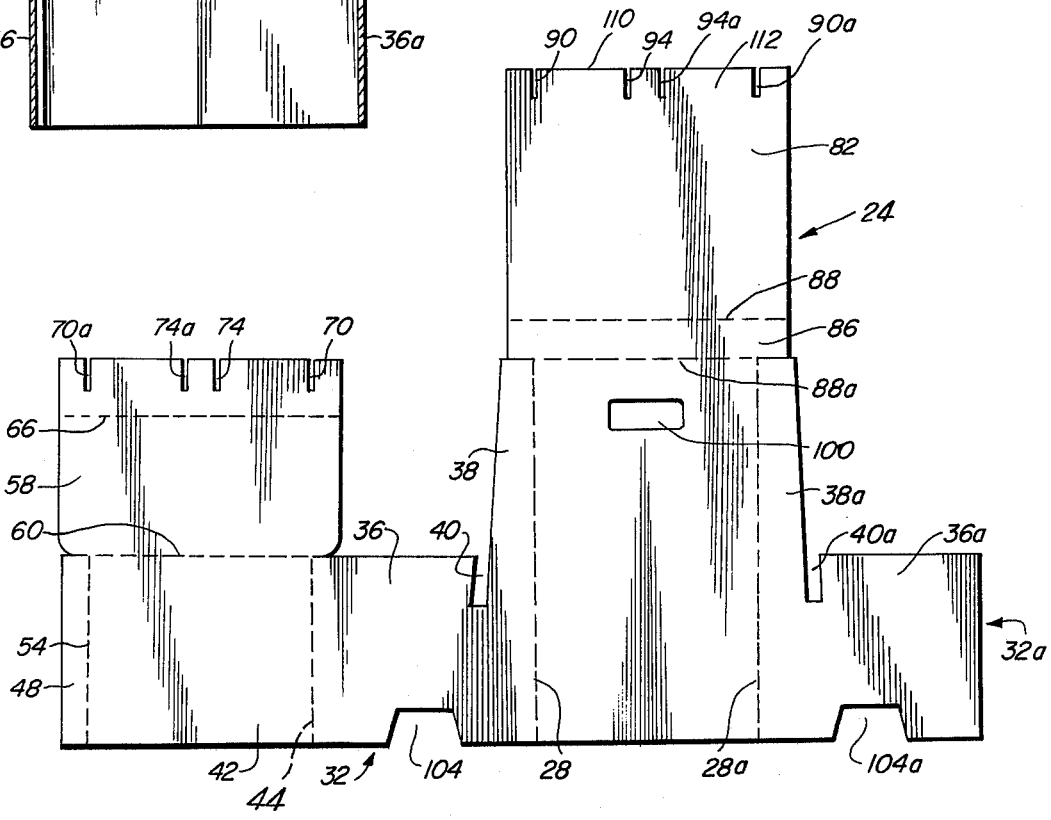
FIG. 12 is a plan view of the chair blank.
Figure 13:
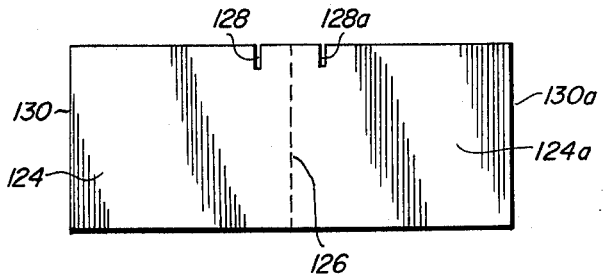
FIG. 13 is a plan view of the auxiliary seat support.

Referring now more particularly to the drawing, in a preferred embodiment of the invention, the chair 20 is fabricated of a single, unitary blank 24. The blank 24 is preferably fabricated of corrugated paperboard or the like diestamped and pre-scored to demark fold lines, as shown in FIG. 12. As illustrated, the blank 24 includes a back panel 26 integrally joined along two opposed parallel fold lines 28 and **28*a* to a pair of side panels 32 and 32*a*. Each side panel is generally L-shaped in configuration, consisting of a seat supporting portion 36 and 36*a* and a back rest supporting portion 38 and 38*a*, each side panel being slotted at 40 and 40*a* along a line constituting an extension of the back rest supporting portion 38 of the panel 32**, for purposes which will become evident as the description proceeds.

A front panel 42 of the chair base is joined to one of the side panels 32 along a pre-scored fold line 44, and in the preferred embodiment of the invention shown, the front panel 42 includes an integrally formed wing flange 48 joined to the free lateral edge of the front panel 42 along a fold line 54. A seat panel 58 is integrally joined to the front panel 42 along a pre-scored fold line 60. At a marginal portion opposite to and paralleling the fold line 60, the seat panel 58 is integrally formed with a locking flange 64 connected to the seat panel proper 58 along a fold line 66. As shown, the locking flange is formed with a pair of outer slots 70 and **70*a* and a pair of inner slots 74 and 74*a*, each slot extending transversely of and opening at the free edge 78 of the locking flange 64**.

A back rest panel 82 is integrally joined to the back panel 26 through an intermediate linking web 86 delineated by a pair of parallel fold lines 88 and **88*a*. The free marginal end portion of the back rest panel 82 is also formed with a pair of outer slots 90 and 90*a* and a pair of inner slots 94 and 94*a*, these being spaced in correspondence with the slots formed in the seat flange 64**, for purposes which will become evident in the further description of the chair structure.

Conveniently, in the preferred embodiment of the invention illustrated, a cut out 100 in the back panel 26 serves as a hand opening facilitating manual transport of the chair. Each side panel 36 and **36*a* is also formed with a cut-out 104 and 104*a*** at the base to suggest leg-like structures.

Figure 8:
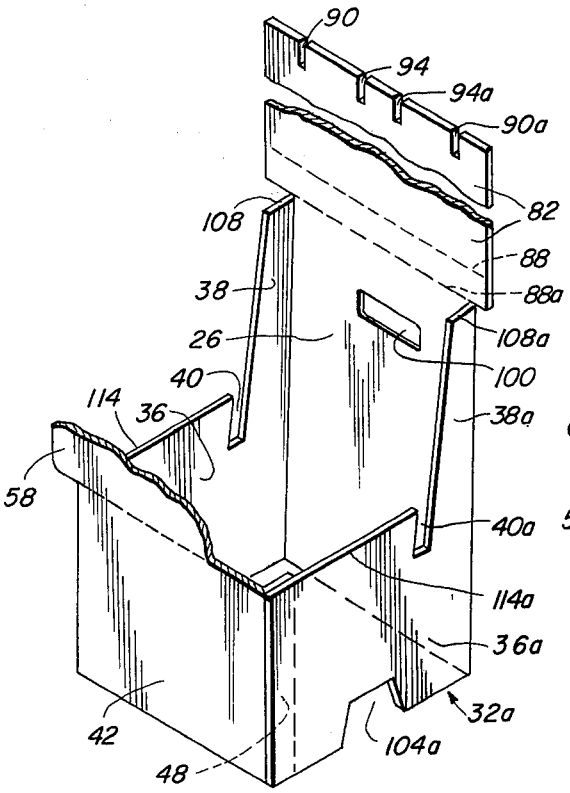
FIG. 8 is a perspective view of the base of the chair with the seat portion cut away and with the back rest portion extending upwardly so as to show more clearly the structure of the chair base itself.
Figure 9:
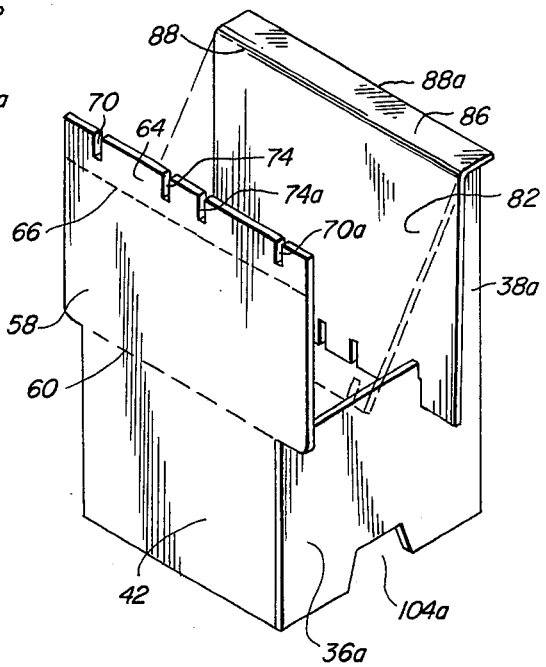
FIG. 9 is a perspective view indicating schematically the positioning of the back rest of the chair prior to pivotally positioning and interlocking the seat panel.
Figure 10:
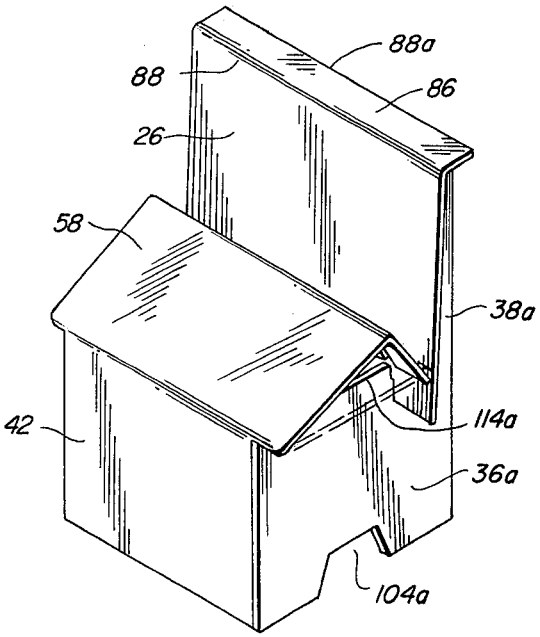
FIG. 10 is a perspective view indicating the back rest panel in place and the seat panel about to be locked in place.

The simple steps in the transformation of the chair structure from a planar blank to an erected, completed item of furniture is described herebelow with reference to FIGS. 8, 9, and 10. As a first step the blank 24 is folded along opposed scored lines 28 and **28*a* so that the side panels 32 and 32*a* project forwardly in a parallel relationship. The front panel 42 is then pivoted about the fold line 44 to bridge between the side panels 32 and 32*a*, and the flange 48 is bent about the fold line 54 and brought into engagement against the marginal inner surface of the side panel 32***a*. While the mode of securement of the flange to the side panel is not critical, in a preferred embodiment of the invention, a pressure sensitive adhesive film is utilized as the securing means. Other fastening means such as pins or staples may be used.

In a second assembly step, the back rest panel 82 is pivoted forwardly about the hinge lines 88 and 88*a* so that the intermediate web 86 abuts and bears upon the top edge surfaces 108 and 108*a* of the backrest supporting portions 38 and 38*a*. The free edge 110 of the back rest panel swings downwardly toward the top edges 114 and 114*a* of the seat supporting portions 36 and 36*a* as the edges slide-through the respective end slots 90 and 90*a* of the back rest panel 82, all as indicated schematically in FIG. 9. The back rest panel 82 is then urged forwardly so that it firmly abuts the upper portions 38 and 38*a* of the side panels 32 and 32*a*, the free, marginal, downwardly directed end 112 of the back rest 82 seating in the opposed slots 40 and 40*a* formed in the side panels 32 and 32*a*.

The final step in the assembly of the chair 20 of the invention is to pivot the seat panel 58 rearwardly along the fold line 60 while bending the end flap 64 about the fold line 66 (FIG. 10). The end flap 64 is inserted downwardly into the slots 40 and 40*a* in the opposed side panels 32 and 32*a* so that the side walls themselves seat in the end slots 70 and 70*a* of the flap 64 to provide a stabilized, completed structure.

Figure 11:
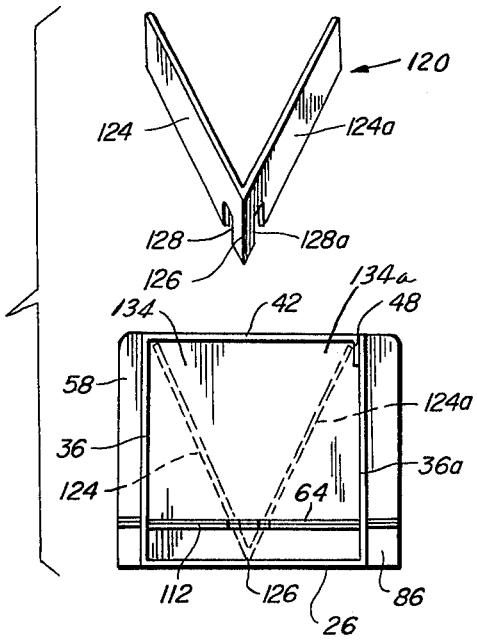
FIG. 11 is a bottom view, exploded to indicate the manner in which the auxiliary support is interlocked with the back rest and the seat.

While the chair structure as described above is complete and self-sustaining, and while it will support considerable weight in use, in order to provide still greater weight support capability, in a preferred embodiment of the invention, and as best seen in FIG. 11, there is provided a generally V-shaped auxiliary strut or support wall 120 consisting of two legs 124 and 124*a* symmetrically disposed about a scored fold line 126. The support wall 120 is formed with a pair of slots 128 and 128*a* opening at an upper edge of the wing elements 124 and 124*a*. As indicated in FIG. 11, the support wall 120 is of the same height as the side panels 36 and 36*a* and so dimensioned that when partially folded about its midline 126, the end edges 130 and 130*a* enter into and seat in the opposed forward corners 134 and 134*a* of the chair base while, concurrently, the slots 128 and 128*a* in the respective legs 124 and 124*a* of the support walls interlockingly engage the downwardly directed marginal portion 112 of the back rest 82 at the inner slots 94 and 94*a* and also the downwardly directed flange 64 of the seat panel 58 at its inner slots 74 and 74*a*, whereby the wall 120 is firmly and securely locked in place to enhance the stability of and to augment support for the chair seat.

What is claimed is:

1. A chair of stiff corrugated paperboard and the like, comprising a. a single pre-stamped and scored blank defining a unitary structure and comprising (1) a seat-supporting base including a pair of laterally spaced opposed side panels and a front panel integrally formed with one of said side panels and connected to forwardly directed vertically extending forward edges of said side panels and extending therebetween, said side panels being generally L-shaped and having integrally formed upward extensions at rearward portions thereof, each of said side panels providing a horizontally disposed seat supporting edge and an upwardly projecting back rest supporting edge, each of said side panels being formed with a downwardly extending upwardly opening slot projecting into the side along a line defined by each said back rest supporting edge as a virtual extension thereof, a downwardly directed lower marginal portion of said back rest panel extending into each said slot to engage said side panels, (2) a back panel integrally joined to each said side panels and bridging between and interconnecting said side panels at rearmost vertically extending extremities thereof, (3) a seat panel integrally formed with and hingedly connected to a top edge of said front panel along a horizontally extending fold line formed at a juncture of said front panel and said seat panel, said seat panel being pivotal rearwardly at said fold line to abut, bear upon, and to cover said horizontally-disposed seat-supporting edge of each of said side panels, (4) a back rest panel integrally formed with and hingedly connected to said back panel along a scored hinge line at a juncture of an upper edge of said back panel with said back rest panel, said back rest panel being pivotal forwardly and downwardly about said hinge line generally to overlie said back panel and to abut and cover said back rest supporting edge of each of said upward extensions of said side panels, and (5) a laterally extending locking flange integrally formed with said seat panel at a rearward terminus thereof and joined to said seat panel along a laterally extending fold line, said locking flange being adapted to project downwardly into and to engage within the slot in each of said side panels and contiguously to abut said lower marginal portion of said back rest panel, thereby to lock said seat panel and said back rest panel firmly in place; and b. a seat-supporting vertical wall generally V-shaped in horizontal section and defining a unitary structure separate from said blank, said wall being disposed as an auxiliary strut within said base of said chair beneath said seat panel, said wall having a height equal to the height of said side panels at each seat supporting edge thereof, whereby, as said seat panel bears upon said seat-supporting edge of each of said side panels, said seat panel also abuts a top edge portion of said wall to constitute an auxiliary weight-bearing support for said seat panel.

2. The chair as set forth in claim 1 wherein said generally V-shaped wall is formed adjacent a rearwardly directed apex region thereof with a pair of spaced laterally-in-line vertical slots in opposed legs of said wall, said slots opening upwardly for receiving said locking flange of said seat panel downwardly therewithin, and wherein diverging free end portions of said wall project into opposed forward corners of said base further to secure said wall fixedly in place.

* * * * *